US007741551B2

(12) United States Patent
Mori

(10) Patent No.: US 7,741,551 B2
(45) Date of Patent: Jun. 22, 2010

(54) INSTRUMENT STAND SYSTEM AND METHODS FOR SUPPORTING AN ELECTRONIC MUSICAL INSTRUMENT

(75) Inventor: Yoshiaki Mori, Hamamatsu (JP)

(73) Assignee: Roland Corporation, Hamamatsu, Shizuoka (JP)

( * ) Notice: Subject to any disclaimer, the term of this patent is extended or adjusted under 35 U.S.C. 154(b) by 398 days.

(21) Appl. No.: 11/962,056

(22) Filed: Dec. 20, 2007

(65) Prior Publication Data

US 2008/0163739 A1 Jul. 10, 2008

(30) Foreign Application Priority Data

Jan. 10, 2007 (JP) ..... 2007-002765

(51) Int. Cl.
*G10D 13/02* (2006.01)
*A45D 19/04* (2006.01)

(52) U.S. Cl. ..... 84/421; 84/411 R; 248/49; 248/127

(58) Field of Classification Search ..... 84/421
See application file for complete search history.

(56) References Cited

U.S. PATENT DOCUMENTS 3,032,603 A * 5/1962 Whitley ..... 174/94 R
5,154,126 A * 10/1992 Newhouse et al. ..... 108/50.02
5,244,104 A * 9/1993 Green et al. ..... 211/150
5,677,513 A * 10/1997 Ito et al. ..... 174/72 A
6,496,371 B2 * 12/2002 Winkel et al. ..... 361/703
6,517,031 B2 * 2/2003 Uchiyama ..... 248/68.1
6,523,795 B2 * 2/2003 Gutgsell et al. ..... 248/188.1
6,610,916 B1 * 8/2003 Torrez ..... 84/421
7,002,066 B2 * 2/2006 Yu ..... 84/327
2006/0081114 A1 * 4/2006 Shimada ..... 84/421

FOREIGN PATENT DOCUMENTS

JP 2006-259193 9/2006

* cited by examiner

*Primary Examiner*—Jeffrey Donels
*Assistant Examiner*—Christopher Uhlir
(74) *Attorney, Agent, or Firm*—Foley & Lardner LLP

(57) ABSTRACT

An electronic percussion instrument stand system includes a hollow pipe structure having a groove and ridge system that allows for wires to be routed along the pipe structure. The exit side of the groove is slightly smaller in diameter than the diameter of the cable which extends through it. The hollow pipe can be constricted or be expanded at the each end of the pipe to allow for a secure hold on the instrument. The hollow pipe connects to a cover that contains reciprocal ridges and grooves that create a strong hold and ease of assembly of the electronic percussion instrument stand system.

11 Claims, 6 Drawing Sheets

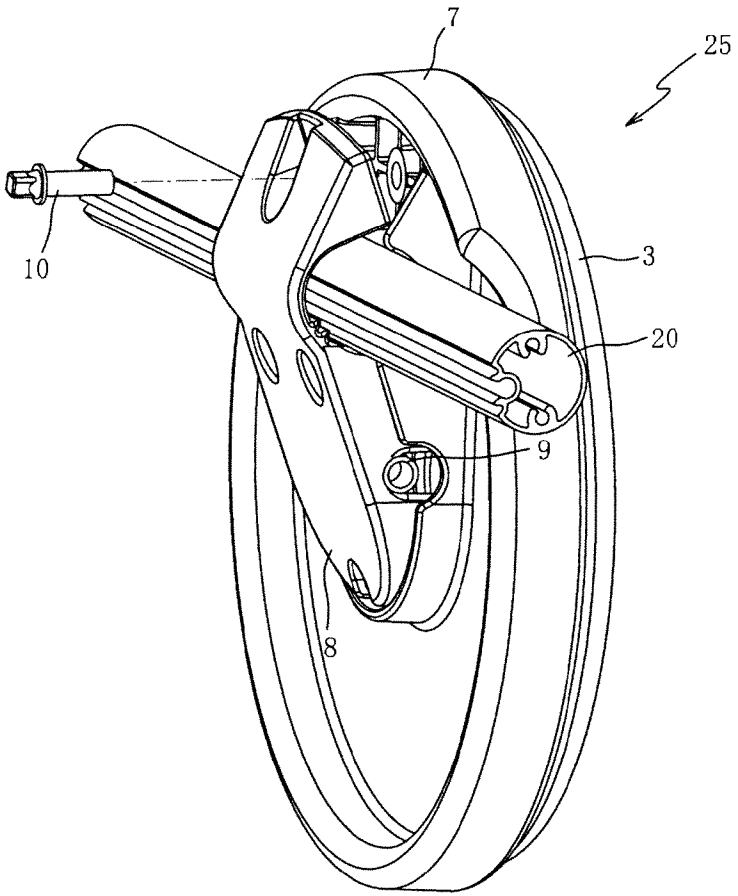
Fig. 2 ( b )
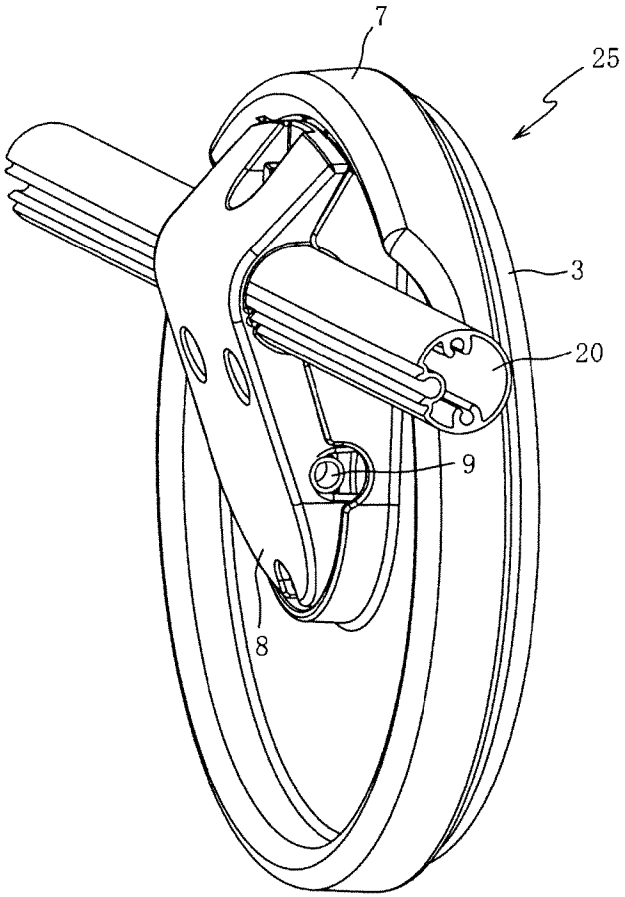
Fig. 2 ( a )

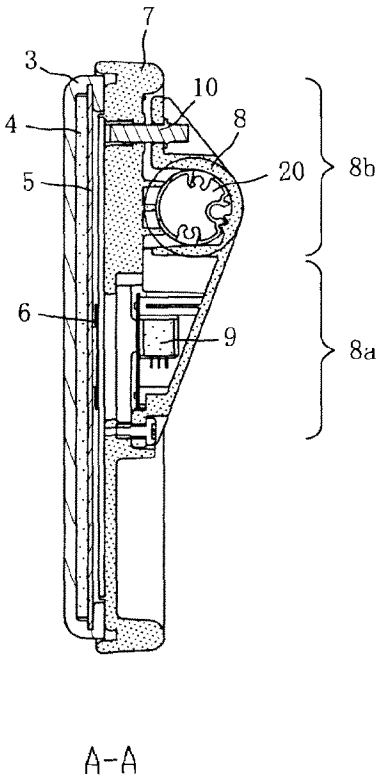
A-A
Fig. 5 ( b )
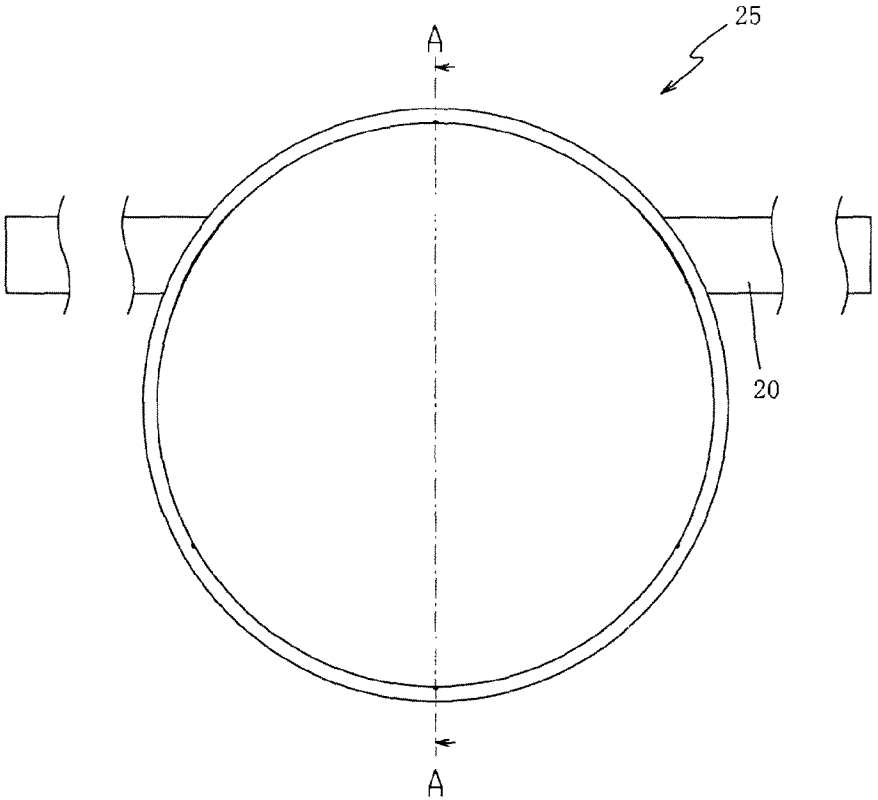
Fig. 5 ( a )

INSTRUMENT STAND SYSTEM AND METHODS FOR SUPPORTING AN ELECTRONIC MUSICAL INSTRUMENT

CROSS-REFERENCE TO RELATED PATENT APPLICATIONS

Japan Priority Application 2007-002765, filed Jan. 10, 2007 including the specification, drawings, claims and abstract, is incorporated herein by reference in its entirety.

BACKGROUND OF THE DISCLOSURE

1. Field of the Invention

Embodiments of the current invention are generally related to electronic percussion instrument stand system and particular embodiments relate to a stand system designed to reduce the number of visible wires and easier to assemble.

2. Background

Currently, various electronic percussion instrument stands are available. However, among other features, embodiments of the stand system efficiently connect with other electronic components through the use of an interlinking cable system. Embodiments of the current invention include various features which can make using the stand system with other electronic components simple and convenient.

Examples of electronic percussion instruments include cymbals, high hat cymbals, snare drums, various types of tambourines, as well as other instruments. Embodiments of the current invention are interoperable with at least the above-mentioned instruments. Sensors on electronic percussion instruments sense the impact of a percussion and translate the percussion into electronic signals, which are converted into sound using other components. The above described ability provides an electronic percussion instrument, a much greater range of sounds than a traditional percussion instrument.

In order for an electronic percussion instrument to create a sound it must send electronic signals through a series of cables and junctions to a sound projection device. Each electronic instrument uses at least one cable to send its signals. Therefore, many cables may be needed. Embodiments of the current invention are able to effectively manage and reduce the number of unsightly cables. Aside from managing the unsightly bundles of cables, embodiments of the current invention reduce set up and take down times of various cables and electronic components.

Another advantage of one embodiment of the stand system can be providing more convenient and less time consuming assembly process for stand systems. In order to assemble previous generations of electronic percussion instrument stands it required painstaking effort to reconnect all of the cables properly as well as reset every component back to the artist's preference. This can take a significant amount of time and effort for those who set up the electronic percussion instrument stand system. This is especially true for percussion instruments because, depending on the stick used there can be a significant amount of force imparted onto various components and that force can easily throw those component out of alignment with each other. Moreover, an improperly assembled stand can lead to structural collapse during a performance.

Embodiments of the current invention are designed to address at least the problems mentioned above. Moreover, embodiments of the current invention can be attractive, easier to assemble, disassemble and can provide a superior electronic percussion instrument stand system.

SUMMARY OF THE DISCLOSURE

One embodiment of the electronic percussion instrument stand system can be constructed out of hollow metallic or other rigid material pipes with a substantially circular cross section around a central core. The pipe can have an opening at each end and can be hollow throughout the entire length of the pipe. The diameter of each opening can be constricted comparative to the inner diameter of the pipe. Running the length of the interior of each pipe, can be a series of ridges and grooves guide systems.

Hollow pipes allow for inclusion of ridge and groove guide system for the passage of connecting cables. These cables connect the components on the stand system with the components and instruments both on and off the stand system. It can be advantageous to have the groove and ridge features on the exterior of the electronic percussion instrument stand for several reasons. The grooves and ridges further strengthen each pipe, the stand system and allow interoperability with other components on the electronic percussion instrument stand system. This embodiment allows the cable to be routed through the primary pipe framing, giving the stand a more organized look and reducing the confusion of cables during assembly. The cable routing also permits the user a convenient method for disassembly. The result is a simple and efficient hollow pipe stand as well as an efficient cable securing system.

Further features of this embodiment allow the ridges and grooves within each pipe to couple with each other providing not only a great amount of stability and security but also a strong framework for the components.

Another embodiment of the electronic percussion instrument stand system can utilize a plurality of ridge and groove guide systems to attach and secure components. The ridge and groove guide system can be designed to prevent musical components from entering too far into the pipe system to prevent overloading or collapse of the stand.

Another embodiment of the electronic percussion instrument stand can be designed for further flexibility and stability. In this embodiment the diameter of the hollow pipe ends can be expanded to keep components secure once they are fitted onto the stand. The interior of these pipes can utilize the above mentioned ridge and groove system to insure stability and facilitate movement of various fitted components. Moreover, the stand system can aid in maintaining structural strength and reducing unwanted vibrations. The stand system also allows for flexibility in positioning various components relative to the stand and to each other.

The feature of expansion of the hollow pipe ends has the ability to move various pipe components and adjust the angle as well as the pitch and height of the various components attached to the arm pipe. This flexibility allows the position of a components to be changed with a simple adjustment and thus the stand system can adapt to nearly any desired position.

Another embodiment of the electronic percussion instrument stand system can use hollow pipes composed primarily of pressed and stretched aluminum. The use of aluminum and other light substantially rigid materials provide the pipes both strength, reduced weight and slight elasticity. This elasticity will allow the stand system to absorb vibrations from repeated strikes on the percussion instruments.

Another embodiment of the electronic percussion instrument stand can allows cables from each component to run the length of the pipe section using the ridges and grooves described above.

The electronic percussion instrument stand system allows cables to travel through the groove structure of the stand. The result of this feature is that without sacrificing the functionality of the stand this embodiment has solved issues relating to cables described above by providing space on the inside of the stand for routing the cables.

Another embodiment of the electronic percussion instrument stand system can have a groove and ridge system that runs the length of the pipe sections.

Another embodiment of the electronic percussion instrument stand system, is designed for flexibility of the various components as well as the constriction function of the hollow pipe end areas. In this embodiment the diameter of the hollow pipe ends can be expanded and the constriction pressure keeps components secure once fitted into the stand. The interior of these pipes also utilizes the ridge and groove system to insure stability and ease of movement of the various fitted components, to maintain overall structural strength and to reduce unnecessary vibration. The above mentioned pipe system also allows for a significant amount of flexibility in positioning the various components relative to the stand and to each other.

The ridge and groove structures in the hollow pipes allows for the interlocking and inlaying of the various pipes through the use of the interlocking ridge and groove feature. This strength brings about a stable structure, and further the interlocking and securing of the various pipe sections to each other means that the electronic percussion instrument stand system will be resistant to any shifting or slippage during performance. Various features of the embodiments described above facilitate greater stability and stand cohesion.

BRIEF DESCRIPTION OF THE DRAWINGS

FIGS. 2(*a*) and (*b*) illustrate a drum pad connecting to an arm pipe as shown in FIG. 1;

FIG. 4(*b*) is an illustration of FIG. 4(*a*) from the perspective of point A;

FIG. 4(*c*) is an illustration of surface groove and ridge structures;

FIG. 5(*a*) is a horizontal view of arm pipe and drum pad connection and connection points;

FIG. 5(*b*) is an illustration of a cross-sectional view of FIG. 5(*a*) as viewed from the line A-A;

FIGS. 6(*b*)-(*d*) are illustrations of FIG. 6(*a*), with the arm pipe and clamp cover inner ridge and groove sections, as viewed at different angular configurations.

DETAILED DESCRIPTION OF PREFERRED EMBODIMENTS

Figure 1:
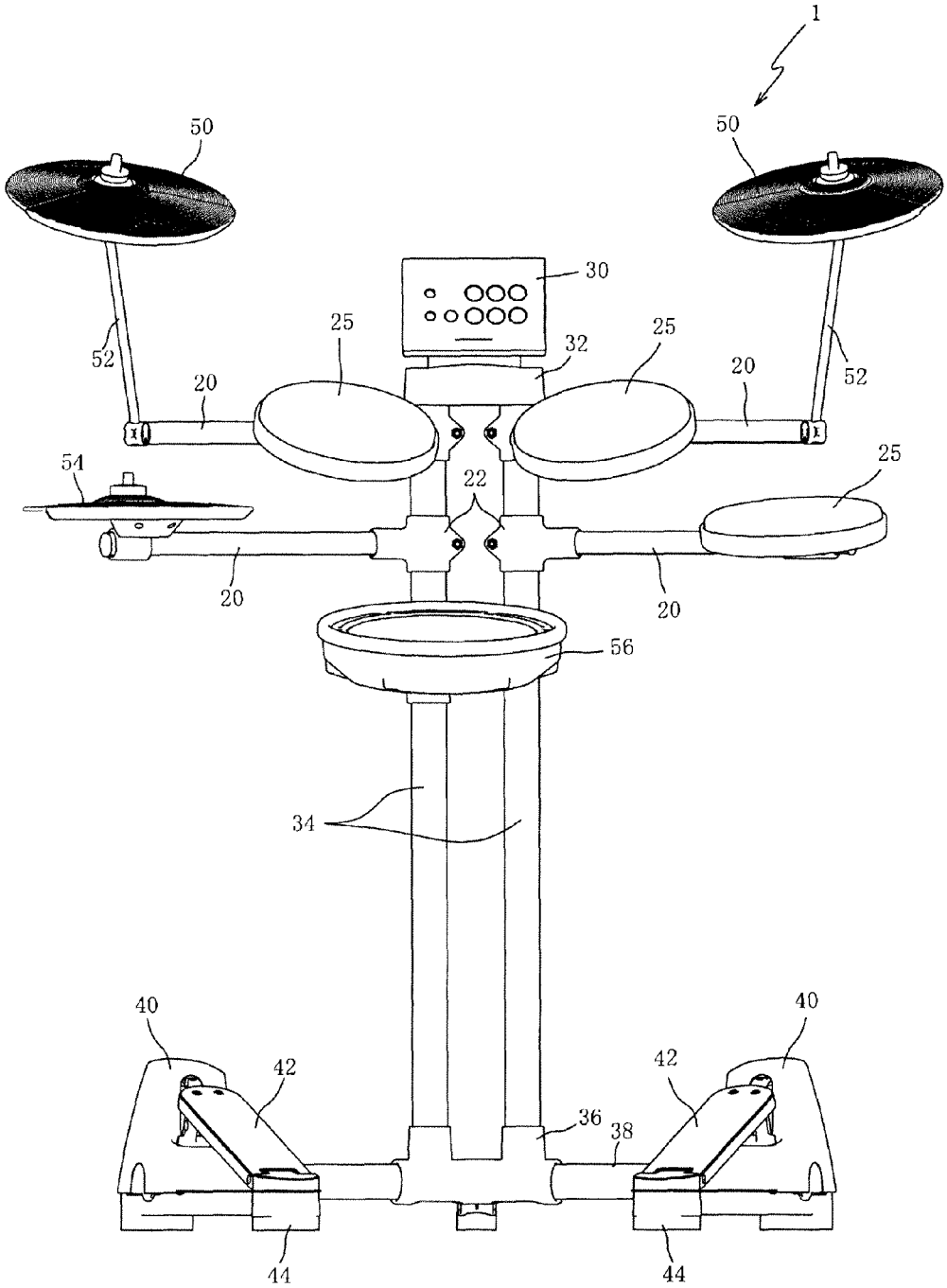
FIG. 1 is a perspective view of an electronic percussion instrument stand according to an embodiment of the present invention.

Embodiments of the electronic percussion instrument stand are described in greater detail below with reference to FIGS. 1 through 6. With reference to FIG. 1, an electronic percussion instrument stand system 1 can be used to support any number of attached components. FIG. 1 shows a perspective view of an electronic percussion instrument stand system according to an embodiment of the present invention.

In FIG. 1, the electronic percussion instrument stand system 1 is shown with a base unit 36 that can be attached to the main pipe 38, and the foot pedal 40, which is connected to the two vertical center pipes 34. The sound unit 30 can be attached vertically or in other directions relative to the main center pipes 34. Also attached to center pipes 34 are the arm pipes 20 and the four arm pipe holders 22. The center pipes 34 can provide the primary support for the four arm pipes 20. As shown in FIG. 1, the four arm pipe holder 22 as well as the left and right arm pipes 20 can be attached to a multitude of various instrument components, such as, but not limited to two cymbal pads 50 and three drum pads 25. Attached to the lower left arm pipe 20 can be a high hat cymbal 54. A snare pad 56 can be connected to the left center pipe 34.

As shown in FIG. 1, the electronic percussion instrument stand system 1 may include one or more of the above components which may be struck by an artist to create a sound. The electronic percussion instrument stand system 1 includes the base 36, a pair of center pipes 34, an instrument component holder 32, four arm pipes 20, four arm pipe holders 22, two foot pedals 40, and the pipe 38. Other embodiments may include more or few center pipes, arm pipes, arm pipe holders and foot pedals.

The two foot pedals 40 allow the artist to use either the right or the left foot pedal. The primary pedal is the pedal 42 and the secondary pedal is the base pedal 44. The primary pedal 42 operates when the sensor located at the center of the pedal 42 senses pressure to indicate a strike upon it. According to the intensity of the strike upon pedal 42, the sensor transmits a signal along the cable 15 (see FIG. 4(*a*)) to the sound component 30, where it is relayed to a sound generating components (not shown). The left foot pedal 40 can be used to play the high hat cymbal 54, from which the sound signal can be transmitted. The right foot pedal 40 can be used to play the bass drum, and the signal is sent from the sensor within the foot pedal 40 to the sound component 30.

The cymbal 50 can be attached to the end of the arm pipe 20 and can be set freely at any angle, pitch or height by adjusting the cymbal rod 52. The high hat cymbal 54 can be attached to the end of the lower left arm pipe 20 or any other suitable arm location.

The various cymbals 50 along with the high hat cymbal 54 can be flat disk shaped objects with a rubber like top surface to absorb the strikes placed upon them when struck. On the bottom surface of the cymbals 50 and the high hat cymbal 54, a sensor can monitor the placement and strength of each strike made upon the top surface of the cymbals 50 and the high hat cymbal 54. The signals created by these sensors can be transmitted on cable 15 to sound component 30.

Figure 3:
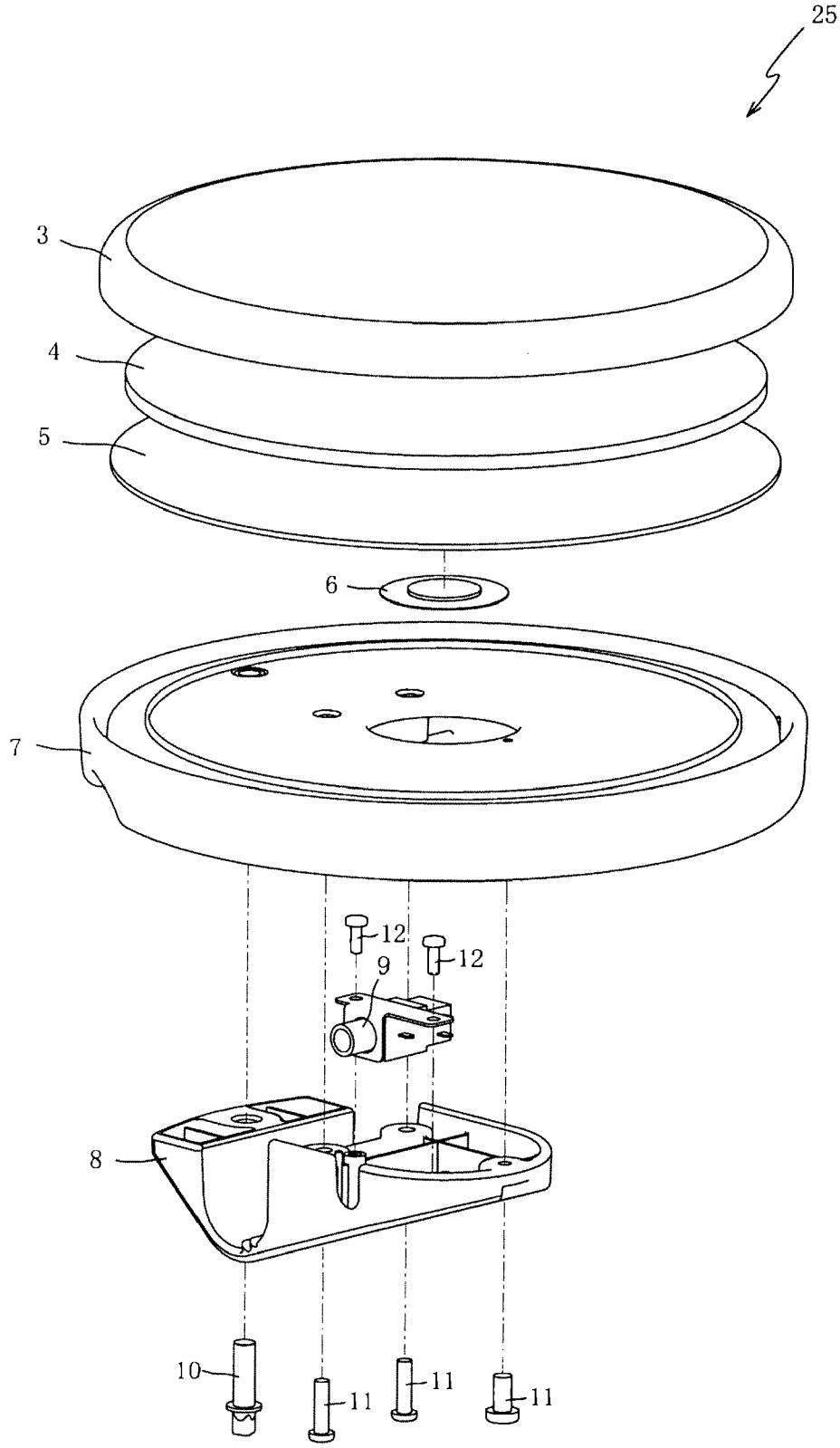
FIG. 3 is a sectional illustration of the drum pad and the clamp from FIG. 2(*a*)

The snare pad 56 can be part of the snare drum assembly. Strikes upon the surface or the head of the snare pad 56 will be registered by another sensor which is placed near the head to monitor all strikes upon the snare pad 56. The three drum pads 25 can be part of the drum assembly. They also contain sensors located in each drum pad 25 which can be connected to the head of the drum to monitor strikes on a drum pad 25. Further detailed information regarding the drum pad 25 and the positions it can take are shown in FIG. 3.

The sound component 30 can receive the sensor data from the cymbals 50, the high hat cymbal 54, the snare drum 56, the drum pads 25 and the foot pedals 40 and is able to send that data on to any other component which may be connected to the unit. The sound component receives these signals from the various sensors and converts them into sound algorithms which can be fed into another component. The level and strength of the signal can be determined by this component. It is possible for the sound component 30 to transmit these signals directly into an amplifier (not shown on the illustration) or directly into a speaker (also not shown in this illustration) or the like.

FIGS. 2(*a*) and 2(*b*) illustrate a connection between the drum pads 25 and the arm pipe 20. As shown in FIGS. 2(*a*) and 2(*b*) the length of the arm pipe 20 and the distance between the three drum pads 25 can be set to the artist's preference. Arm pipe 20 connects with three drum pads 25, frame 7 and a connection structure or clamp cover 8. The clamp cover 8 is connected to a jack 9 to relay the sensor signals.

A portion of the clamp cover 8 can be located between the arm pipe 20 and the frame 7. According to FIG. 2, the arm pipe 20 can be connected to the frame of the drum pad, from below the frame 7 (see FIG. 5, stationary portion 8*a*) and can be attached to the frame by screws or the like. The area above the attaching point of arm pipe 20 (see FIG. 5, grip structure 8*b*) can be attached to the frame by the bolt 10. In FIG. 2 (*a*) the bolt 10 is holding the constriction structure 8*b* to the frame 7 with the upper edge of the constriction structure 8*b* attached via the bolt 10 to the frame 7. FIG. 2(*b*) shows the bolt 10 separated from the constriction structure 8*b*, with the upper edge of the constriction structure 8*b* separated from the frame 7 creating a small gap or opening.

The clamp cover 8 can be made of elastic resin (ABS) or other semi-flexible material. When the bolt 10 is tightened to the clamp cover 8, the arm pipe 10 is affixed to the drum pad 25. However when the bolt 10 is loosened or removed, the arm pipe 20 is not affixed to the drum pad 25 and a user can move the arm pipe 20 and the drum pad 25 to a desired position.

FIG. 3 shows the position and structure of the drum pads 25. The drum pads 25 can be made of the following components: striking surface 3, cushion 4, sensor plate 5, sensor 6, frame 7, and the clamp cover 8.

The input from the striking surface 3 varies depending on the stick used as well as the force applied to the drum head by the strike. The surface of the striking surface 3 can be composed of a thick layer of EPDM gum resin or the like. The cushion 4 can be underneath in a horizontal position to the striking surface 3. The cushion 4 absorbs the shock coming from a strike upon the striking surface 3, depending upon the type of stick used and the force applied to each strike. Depending on the stick, the cushion 4 dampens the rebound energy and shock energy to the striking hand. Cushion 4 can be made from a type of polyurethane resin and a cellular urethane (such as PORON, a trademark of Rogers Corporation) resin or the like.

The sensor plate 5 is connected to the sensor 6 and acts as a receptor for the strikes against the drum head to activate the sensor to the amplitude and position of each strike without damaging or contacting the sensor directly. The sensor plate 5 can be shaped like a flat saucer and can be connected directly to the frame 7. Sensor plate 5 can be supported by the rib of the frame 7. The central area below the sensor plate 5 is not supported by frame 7. Attached to the central area is a sensor 6. This configuration allows the sensor 6 to optimally receive input and transmit.

Sensor 6 can be constructed of piezo crystals or the like, to convert the surface contact directly into electrical signals which can be reconverted to sound with minimal degradation of the original signal. The sensor 6 can be taped on or coupled on both sides to the sensor plate 5 and the input received by the sensor 6 is transmitted directly to jack 9.

The frame 7 can be considered the body of the drum part 25. The frame 7 can be created from ABS elastic resin or the like to absorb shock and damage. The external structure of the frame 7 is a vertically oriented cylinder that contains sensor plate 5 in its center and a series of ribs around it (not shown). These ribs allow the sensor plate 5 to operate without having to directly contact the strike surface and are placed around the circumference of the frame 7 to support it. The sensor 6 can be at the center of this configuration. The sensor 6 is held in place below the sensor plate 5 in order to maximize reception without risk of damage to the sensor 6. The frame 7 can have a cylindrical penetration hole in its central part. The size of the path of this penetration hole can be larger than the outer circumference of a sensor 6. The frame 7 does not directly contact the sensor 6, because that can cause damage to the sensor 6, due to movement of the frame 7 during play. The lead wire can connect the sensor 6 to a jack 9 to communicate electrical signals.

The clamp cover 8 can provide the connection structure between the arm pipe 20 and the drum pads 25. The clamp cover 8 also contains the jack 9 to the drum pads 25 to connect directly with the sensor 6. The clamp cover 8 can be made of the same shock resistant elastic ABS resin or the like as the frame 7. The clamp cover 8 can be an external piece that connects the frame 7 with the arm pipe 20, and can be composed of the stationary portion 8*a* and the grip structure 8*b*.

The stationary portion 8*a* is connected to the frame 7 by the three screws 11. The stationary portion 8*a* attaches the frame 7, the clamp cover 8 and jack 9. The jack 9 is attached using two screws 12 to the clamp 8.

Figure 4:
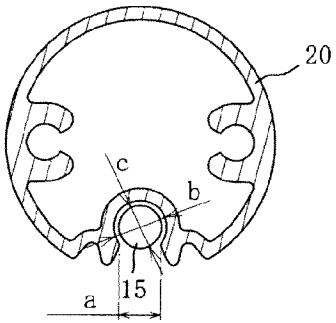
FIG. 4(*a*) an illustration of an arm pipe and an inner structure of the cable which runs through the arm pipe surface groove structure.
Figure 4:
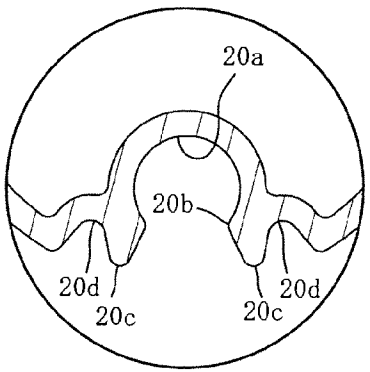
Figure 4:
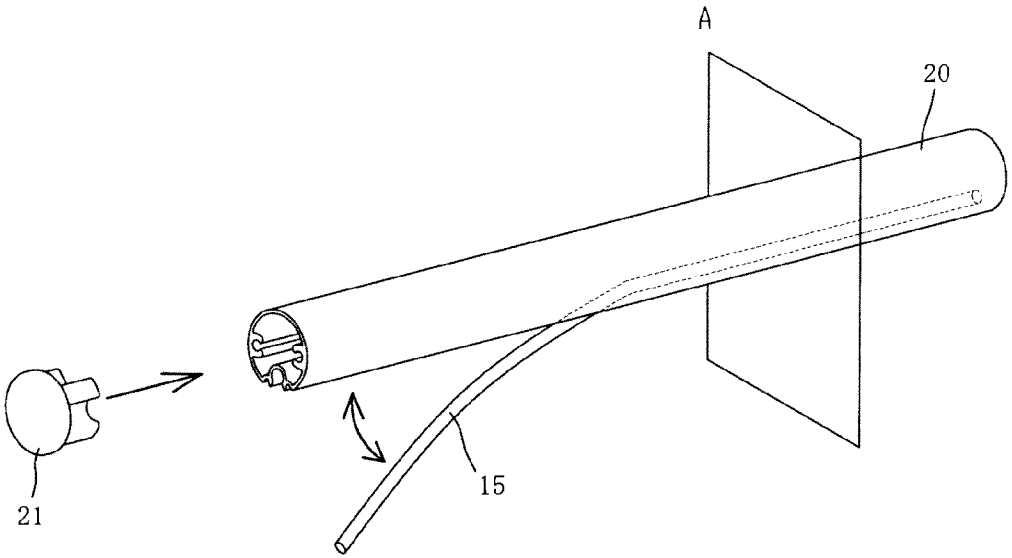

The grip structure 8*b* can have a half circular shaped surface structure facing the arm pipe 20 and can be attached to the frame 7 by securing the bolt 10. If the bolt 10 is not secured through the grip structure 8*b* to the frame 7, then the frame 7 can be detachable from the stand. However, if the bolt 10 is secured through the grip structure 8*b* to the frame 7, then the frame 7 can be securely attached to the stand. FIGS. 4(*a*) and 4(*b*) illustrate the groove and ridge structure along with the arm pipe 20. This groove and ridge structure provides greater connective strength to the stand system and greater stability to drum pad 25.

The clamp cover 8 can be connected to the arm pipe 20 and the angle of this connection can be varied. The bolt 10 can be loosened to allow the arm pipe 20 to move freely and be repositioned into any desired position. This process is reversible, meaning the arm pipe 20 can be secured by tightening the bolt 10 back into place to secure the arm pipe 20 and clamp cover 8.

Next, as shown in FIGS. 4(*a*)-4(*c*), details of the arm pipe 20 are described and illustrated. FIG. 4(*a*) shows the arm pipe 20 and cable 15 which runs through the arm pipe 20. FIG. 4(*b*) illustrates the interior of the arm pipe 20. While FIG. 4(*c*) shows the details of the ridges and grooves guide system.

As FIG. 4(*a*) illustrates the arm pipe 20 can be a hollow pipe which can be capped at the end with a arm cap 21. The arm pipe 20 can made of aluminum or the like, for example a combination of pressed and stretched aluminum metals. The arm pipe 20 can be a component of the center pipe 34 and can be positioned parallel to the center pipe 34.

As is illustrated in the FIG. 4(*a*) from the exterior view of the arm pipe 20, the cable 15 may not be visible as it runs along the interior length of the arm pipe 20 through the groove 20*a* on the exterior surface of the arm pipe 20. The diameter of the cable 15 in this example embodiment can be approximately 4 mm, but can vary according to the cable width. The width (perpendicular to the axial dimension) or diameter of the groove 20*a* which runs along the arm pipe 20 can be approximately 5 mm, while the open side or entrance and the exit constriction structure 20*b* of the groove 20*a* can be approximately 3.9 mm, in this example embodiment.

Therefore the diameter of the exit constriction structure 20*b* of the interior groove 20*a* can be smaller than the diameter of the cable 15 which runs through the arm pipe 20. The exterior coating of the cable 15 can be made of elastic materials which allow the cable 15 to be routed through the interior groove 20*a*. The cable 15 can be compressed to fit the exit constriction structure 20*b* without damaging the cable 15. The cable 15 fits securely into the groove 20*a*, because the cable 15 runs through the arm pipe 20, and is compressed by the exit constriction structure 20*b*. However it can be easy to remove the cable 15 from the interior groove 20*a*, by a slightly forceful pull upon the cable to pop it out of the interior groove 20*a* and the exit constriction structure 20*b*.

The surface groove 20*a* ends in the exit constriction structure 20*b* which is formed by two parallel ridges 20*c*. On either side of the two ridges 20*c* can be at least two grooves 20*d*. This ridge and groove structure 20*c* and 20*d* can also be formed in an identical ridge and groove structure in the connecting clamp cover 8. As discussed above this is all part of the over all connective structure which includes the clamp cover 8, the frame 7 and the bolt 10. When the drum pad 25 is connected to the overall structure via this system, the drum pad 25 will remain connected to the arm pipe 20, even if the drum pad is struck with a large force and even if the bolt 10 is loose. This is primarily due to various secondary connective structures which will not allow for significant movement in the connected components.

FIGS. 5(*a*) and 5(*b*) show the connection between the drum pad 25 and the arm pipe 20. FIG. 5(*a*) shows details in a horizontal cross section along the axis A-A. FIG. 5(*b*) illustrates the relationship between the frame 7, the bolt 10, the clamp cover 8 and its stationary portion 8*a*, the grip structure 8*b* and the clamp cover 8 being coupled to the arm pipe 20.

Figure 6:
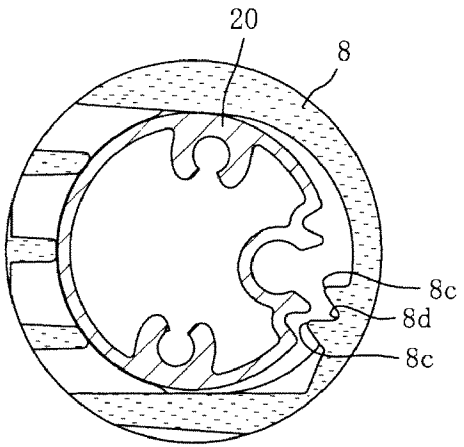
FIG. 6(*a*) is an illustration of inner ridge and groove portion of the clamp cover and its connection and connection points with the inner ridge and groove structure within the arm pipe.
Figure 6:
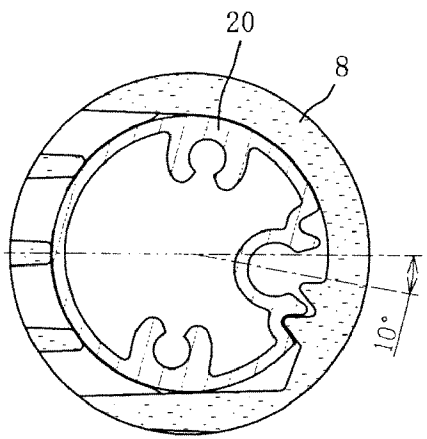
Figure 6:
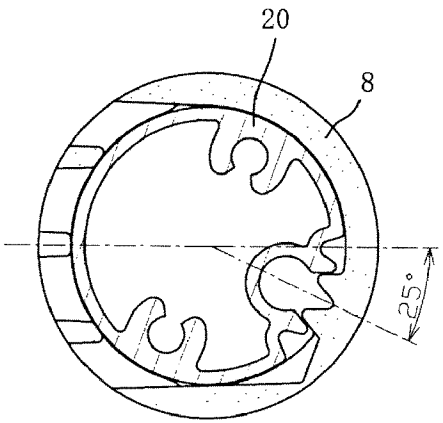
Figure 6:
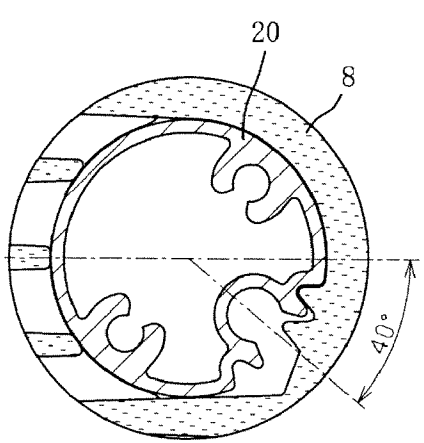

FIGS. 6(*a*)-6(*d*) illustrate the grip structure 8*b* and its connection to the arm pipe 20 as well as the engagement between the two. FIG. 6(*a*) illustrates the condition in which the bolt 10 is not in a secured position. Also illustrated in FIG. 6(*a*) is the clamp cover 8, surface ridge structures 8*c* and the surface groove structure 8*d*. In FIG. 6(*a*), the ridge and groove structures 8*c* and 8*d* are shown as disconnected from the arm pipe 20 ridge and groove structures (20*c* and 20*d*). In this state the drum pads 25 can be moved along the length of the arm pipe 20 and changes to the pitch and angle of drum pad 25 or other components relative to the arm pipe 20 can be made.

FIG. 6(*b*) illustrates the ridge and groove structures of the clamp cover 8 connected to the ridge and groove structures of the arm pipe 20 (20*c* and 20*d*). The clamp cover 8 can be tightened and loosened to allow the arm pipe 20 to rotate. From the center of the half circle shaped clamp cover 8 and the center of the arm pipe groove structure 20*a*, the angular movement permitted between the arm pipe 20 and the clamp cover 8 is approximately 10 degrees.

FIG. 6(*c*) illustrates the interaction of the groove and ridge structures of the clamp cover 8 and the arm pipe 20. FIG. 6(*c*) shows various parts as they would appear in another example using the grooves and ridges structure. The clamp cover 8 can be tightened and loosened to allow the arm pipe 20 to rotate. The clamp cover 8 ridge and groove structure and the arm pipe 20 ridge and groove structure are positioned such that the groove 20*a* forms a connection, as shown, and is capable of over 25 degrees of angular movement.

FIG. 6(*d*) illustrates the position and attachments of the arm pipe 20 and its groove 20*a*, the ridge and groove structures (20*c* and 20*d*) and the clamp cover 8 ridge and groove structures 8*c* and 8*d*. The clamp cover 8 can be tightened and loosened to allow the arm pipe 20 to rotate. The clamp cover 8 ridge and groove structure 8*d* and the arm pipe 20 ridge and groove structure (illustrated as ridge structure 20*c*) align with each other, allowing over 40 degrees of angular movement.

As has been explained and illustrated in embodiments of this invention, the electronic percussion stand system, is composed of at least a hollow pipe structure arm pipe 20 on which is formed a groove 20*a*, where the exit constriction structure 20*b* of this groove 20*a* is slightly smaller in diameter than the diameter of the cable 15 which extends through it. Thus while the cable 15 can easily run through the channel of the groove 20*a*, at the position where the cable 15 exits the arm pipe 20, the groove 20*a* is constricted at the exit constriction structure 20*b* in order to secure the cable 15 into position so that it will not slip out or accidentally move during transport or play.

Also the exit structure at the end of the arm pipe 20, 20*b* is formed out of two ridges and a middle groove. In order to better provide stability and strength to the overall structure this ridge and groove system is formed into the piping itself. Because the exit constriction structure 20*b* for the arm pipe 20 is formed into the pipe structure itself, there can be at least three possible angular degree combination possibilities which offers a wider range of movement to each component.

While the above explanation relates to illustrated embodiments of the present invention, the flexibility of the above-described designs can provide a wide range of possible configurations within the scope of the present invention. The possible range of variations of positioning and format can make the stand system highly versatile.

For example, in the above description of an electronic percussion instrument stand system, only such components as the cymbals and drum pads are identified as attached instruments. However, in other embodiments, any suitable type of electronic instrument may be attached to the disclosed stand system. In other words, the versatility of embodiments of the invention allows embodiments to not only support electronic percussion instruments but could also support other kinds of electronic instrument or even a combination of the two.

Also, in the above detailed and illustrated configuration, the cable 15 communicates data from the above described sensors through to the sound controller component 30. However, the sensor electronic signals communicated through the cable 15 do not have to go to the sound component 30, but could be run through a MIDI, or into another electronic media device such as a digital serial signal carrier or the like. The output of the attached components, being electronic, can be adapted into any format through any form of media the user desires.

What is claimed is:

1. An electronic instrument stand system for supporting an electronic musical instrument connected with an electrical cable having a cable width dimension, the system comprising:

at least one tubular pipe member;

said at least one tubular pipe member comprising a generally rigid pipe having a length dimension, an exterior surface, a generally hollow interior and at least one groove formed along the exterior surface and extending in the length dimension of the pipe; and said at least one groove forming a channel having an open side extending along the length dimension of the pipe, wherein the channel and the open side each have a respective width dimension generally perpendicular to the length dimension of the pipe, wherein the width dimension of the open side is constricted to be smaller than the width dimension of the channel;

wherein the width dimension of the channel of said at least one groove is suitable for accommodating the electrical cable, and wherein the width dimension of the open side of said at least one groove is smaller than the width dimension of the electrical cable and; a connection member connects at least one electronic instrument to each tubular pipe member, the connection member having an accommodating portion having a shape for receiving a portion of the length of the generally rigid pipe, wherein one of the accommodating portion and the generally rigid pipe has at least one projection and the other of the accommodating portion and the generally rigid pipe has at least one further groove for receiving the at least one projection.

2. A system as recited in claim 1, wherein the generally rigid pipe is formed of pressed aluminum or stretch formed aluminum.

3. A system as recited in claim 1, further comprising at least one electronic instrument supported by the generally rigid pipe and at least one electrical cable electrically connected to the at least one electronic instrument and electrically connectable to an external electrical device, wherein the at least one electrical cable extends within the at least one groove formed along the exterior surface of the generally rigid pipe and is held within the channel of the at least one groove and inhibited from falling out of the channel by the constriction of the open side of the channel.

4. A system as recited in claim 1, wherein the at least one further groove is provided along the length dimension of the generally rigid pipe and allows the connection member to slide along the length dimension of the generally rigid pipe when the at least one projection is received within the at least one further groove.

5. A system as recited in claim 1, wherein the width dimension of the channel is approximately 5 mm and the width dimension of the open side is approximately 3.9 mm.

6. An electronic musical instrument stand system comprising:

a center pipe structure including at least one center pipe;

a base structure for supporting the center pipe structure in an upright orientation;

at least one first arm formed of at least one hollow pipe for supporting at least one electronic percussion instrument and joined to the center pipe, said at least one hollow pipe having an axial length dimension, an exterior surface and at least one groove extending along the external surface in the axial length dimension of the pipe to allow an electrical cable for carrying sound signals to be routed within the groove; wherein the at least one groove forms a channel having an open side extending along the axial length dimension of the pipe, wherein the channel and the open side each have a respective width dimension of the open side is constricted to be smaller than the width dimension of the channel; wherein the width dimension of the channel of said at least one groove is suitable for accommodating the electrical cable, and wherein the width dimension of the open side of said at least one groove is smaller than the width dimension of the electrical cable and; wherein a connection member connects at least one electronic instrument to said at least one first arm, the connection member having an accommodating portion having a shape for receiving a portion of the length of the hollow pipe, wherein one of the accommodating portion and the hollow pipe has at least one projection and the other of the accommodating portion and the hollow pipe has at least one further groove for receiving the at least one projection.

7. A system as recited in claim 6, further comprising at least one electronic instrument supported by the hollow pipe and at least one electrical cable electrically connected to the at least one electronic instrument and electrically connectable to an external electrical device, wherein the at least one electrical cable extends within the at least one groove extending along the exterior surface of the generally rigid pipe.

8. A system as recited in claim 7, wherein the at least one groove forms a channel having an open side extending along the axial length dimension of the hollow pipe and wherein the electrical cable is held within the channel of the at least one groove and inhibited from falling out of the channel by a constriction of the open side of the channel.

9. A system as recited in claim 7, wherein the at least one groove forms a channel having an open side extending along the axial length dimension of the hollow pipe, wherein the channel and the open side each have a respective width dimension generally perpendicular to the axial length dimension of the pipe, wherein the width dimension of the open side is constricted to be smaller than the width dimension of the channel.

10. A system as recited in claim 6, wherein the at least one further groove is provided along the length dimension of the hollow pipe and allows the connection member to slide along the length dimension of the hollow pipe when the at least one projection is received within the at least one further groove.

11. A system as recited in claim 6, wherein the at least one groove forms a channel having an open side extending along the axial length dimension of the pipe, wherein the channel and the open side each have a respective width dimension generally perpendicular to the axial length dimension of the pipe, wherein the width dimension of the channel is approximately 5 mm and the width dimension of the open side is approximately 3.9 mm.

* * * * *